US006199730B1

(12) United States Patent
Chisolm

(10) Patent No.: US 6,199,730 B1
(45) Date of Patent: Mar. 13, 2001

(54) WRISTBAND HAVING A PROTECTIVE COVER FOR A WATCH OR THE LIKE

(75) Inventor: Beirne Chisolm, Salt Lake City, UT (US)

(73) Assignee: Chisco, Inc., Salt Lake City, UT (US)

( * ) Notice: Subject to any disclaimer, the term of this patent is extended or adjusted under 35 U.S.C. 154(b) by 0 days.

(21) Appl. No.: 09/496,225

(22) Filed: Feb. 1, 2000

(51) Int. Cl.[7] ..... A44C 5/00

(52) U.S. Cl. ..... 224/164; 224/166; 224/173; 224/219; 24/265 WS

(58) Field of Search ..... 224/219–222, 224/164, 166, 168, 171, 172, 173; 24/265 WS; 368/281, 282, 283

(56) References Cited

U.S. PATENT DOCUMENTS

| | | | |
|---|---|---|---|
| D. 287,229 | | 12/1986 | Hallman et al. . |
| D. 365,442 | | 12/1995 | Davis et al. . |
| D. 372,878 | | 8/1996 | Finnegan . |
| D. 383,993 | | 9/1997 | Kalbach . |
| 2,998,695 | * | 9/1961 | Cornett ..... 224/171 X |
| 4,103,808 | | 8/1978 | Hallman et al. . |
| 4,155,219 | * | 5/1979 | Anderson ..... 224/168 X |
| 4,489,867 | * | 12/1984 | Schwemberger ..... 224/219 X |
| 5,332,135 | * | 7/1994 | Fletcher ..... 224/164 |
| 6,073,821 | * | 6/2000 | Mercer et al. ..... 24/265 WS |
| 6,108,876 | * | 8/2000 | Hubbert ..... 24/265 WS |

FOREIGN PATENT DOCUMENTS

| | | | |
|---|---|---|---|
| 80927 | * | 6/1949 | (NO) ..... 224/164 |

* cited by examiner

*Primary Examiner*—Gregory M. Vidovich
(74) *Attorney, Agent, or Firm*—Morriss, Bateman, O'Bryant & Compagni

(57) ABSTRACT

A wristband or watchband is disclosed having a first band sized for encircling a wearer's wrist, a watch-engaging member and a protective cover for securing over the watch, or other measuring device or ornament, to protect it from exposure or damage. The configuration of the wristband of the present invention facilitates attachment of the wristband to the wearer's wrist and reduces the cost of manufacture in comparison to similar watchbands previously known.

11 Claims, 3 Drawing Sheets

WRISTBAND HAVING A PROTECTIVE COVER FOR A WATCH OR THE LIKE

BACKGROUND

1. Field of the Invention

This invention relates to watchbands or similar wristbands for retaining a watch or other device, and specifically relates to a watchband or wristband having a protective cover to cover the watch or device from exposure.

2. Description of Related Art

Watchbands, or similar wristbands structured to retain a timepiece or the like, have been disclosed in the art. Furthermore, watchbands having a cover or flap for covering a watch have been disclosed in the art. Such watchbands are generally structured to cover the watch so that it is not directly exposed to the elements. Persons who are active in outdoor sporting activities or who are involved in military maneuvers find such watchbands particularly beneficial.

Watchbands as previously described are disclosed in U.S. Pat. No. 4,103,808 to Hallman, et al., U.S. Design Pat. No. 287,229 to Hallman et al., and U.S. Design Pat. No. 383,993 to Kalbach. While useful for their purpose, known watchbands, such as those disclosed in the identified patents, have certain disadvantages of construction which render the particular watchband either difficult to use or more expensive to manufacture. For example, the watchband disclosed U.S. Pat. No. 4,103,808 is structured to retain a watch casing in a more permanent manner, thereby rendering the watchband unsuitable for readily switching watchbands or watch casings.

Thus, it would be advantageous to provide a wristband which is structured with a protective cover, but which is simplified in construction and use, which is less expensive to manufacture and which enables the ready removal of the watch or other device from the wristband at the discretion of the wearer.

BRIEF SUMMARY OF THE INVENTION

In accordance with the present invention, a wristband is configured to retain a watch, instrument or ornament on the wrist in a selectively releasable manner and further provides a protective cover for preventing exposure of the watch, instrument or ornament to the environment. The present invention is particularly configured to facilitate placement of the watch, instrument or ornament on the wristband, to facilitate attachment of the wristband to the wearer's wrist and to reduce the cost of manufacture of the wristband. While the wristband is described herein with respect to a watchband for a watch, the wristband may be adapted to any other type of device or ornament desired for wearing on the wrist.

The wristband of the invention, referred to hereinafter more specifically as a watchband, is comprised of a first band which is sized to encircle a wearer's wrist, a watch-engaging member extending from the first band and a protective cover for positioning over a watch or other item retained by the watch-engaging member. The first band is configured with a band closure which enables the first band to be encircled about the wrist and held in place there. The band closure may take any appropriate form, such as snaps, buckles, hook and eye mechanisms or magnets. In a particularly suitable embodiment, however, the band closure may be interlocking hook and loop material of the type sold under the trademark Velcro®, and preferably the band closure is comprised of the nappy fabric portion of the hook and loop material (although it may alternatively comprise the nylon loop portion). The watchband of the present invention differs from similar known watchbands in providing a band closure which only extends a portion of the length of the first band, thereby facilitating attachment of the watchband to the wrist and reducing the amount of material required in manufacture of the watchband.

The watch-engaging member is configured to retain a watch or other measuring device or ornament on the watchband and may generally comprise a length of flexible material capable of engaging the watch casing. In a particularly suitable embodiment, the watch-engaging member may be a ribbon of material, one side of which bears a reciprocating closure member positioned to engage the band closure of the first band. When structured with hook and loop material, the reciprocating closure member is the opposing type of material to that used for construction of the band closure. The watch-engaging member thus serves the dual purpose of retaining the watch on the watchband and engaging the band closure to keep the first band in position encircled about the wearer's wrist.

In a particularly suitable embodiment, the watch-engaging member is sized in length to be at least ninety percent of the length of the first band, and is preferably less than sixty percent of the length of the first band. Reducing the length of the watch-engaging member not only reduces the amount of material required for manufacture of the watch-engaging member, but facilitates attachment of the watchband to the wearer's wrist in that the watch-engaging member does not need to wrap about the entire circumference of the wrist to complete the attachment. The watch-engaging member may even be sized in length to be equal to or less than the length of the band closure, thereby also reducing costs of manufacture and facilitating attachment of the watchband to the wrist.

The protective cover of the present watchband extends from the first band in the same direction as the watch-engaging member and is sized in length to cover a watch or other ornament secured to the watchband. The protective cover may, most suitably, be sized in length to be equal to or longer than the length of the watch-engaging member. The protective cover is configured with a cover closure member which is positioned to engage at least a portion of the band closure to effectively secure the protective cover in position over the watch. The cover closure member may be the reciprocating material of a hook and loop closure, as previously described, or may comprise any other suitable means for engaging the band closure.

In an alternative embodiment, the watch-engaging member may be further structured with a closure member positioned to engage at least a portion of the cover closure member such that when the watchband is to be removed from the wrist, the protective cover and watch-engaging member can be released simultaneously from the band closure of the first band to retain the watch in secure engagement with the watchband, thereby avoiding loss of the watch.

These and other beneficial aspects of the present invention will be more apparent by reference to the illustrations and detailed description of the invention which follows.

BRIEF DESCRIPTION OF THE SEVERAL VIEWS OF THE DRAWINGS

In the drawings, which currently illustrate what is considered to be the best mode for carrying out the invention.

DETAILED DESCRIPTION OF THE INVENTION

Figure 1:
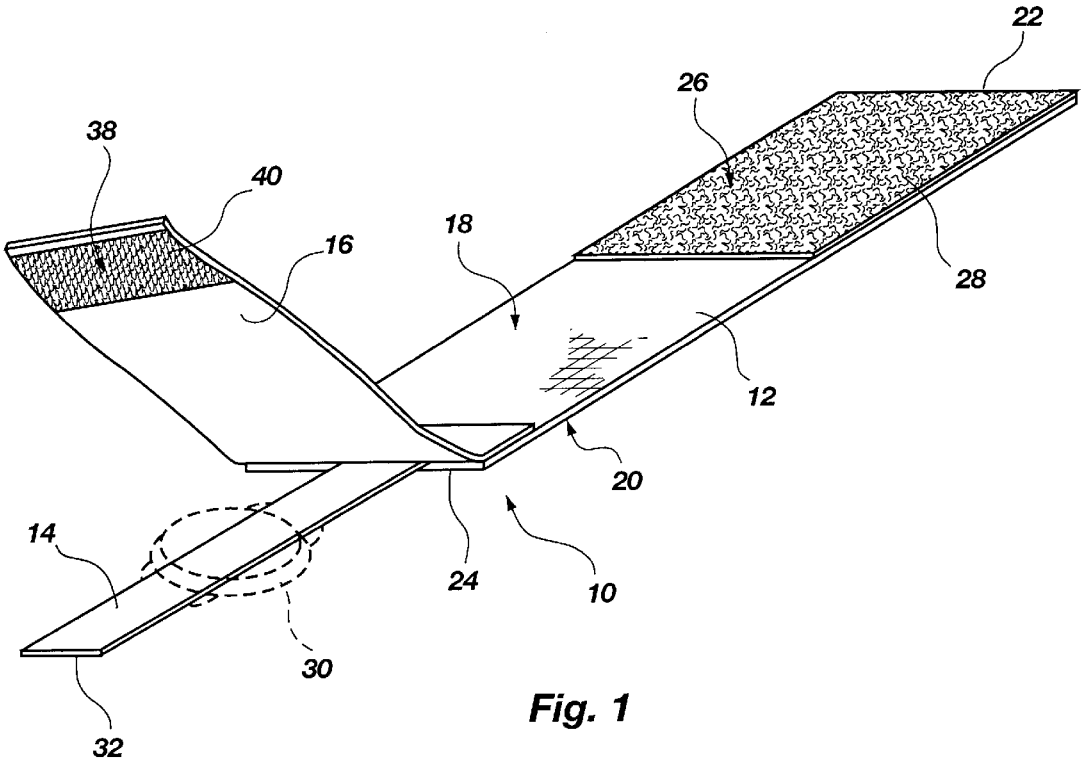
FIG. 1 is a perspective view of a first embodiment of the wristband of the invention where the surface of the wristband which is oriented away from the wearer's body is directed upward.
Figure 2:
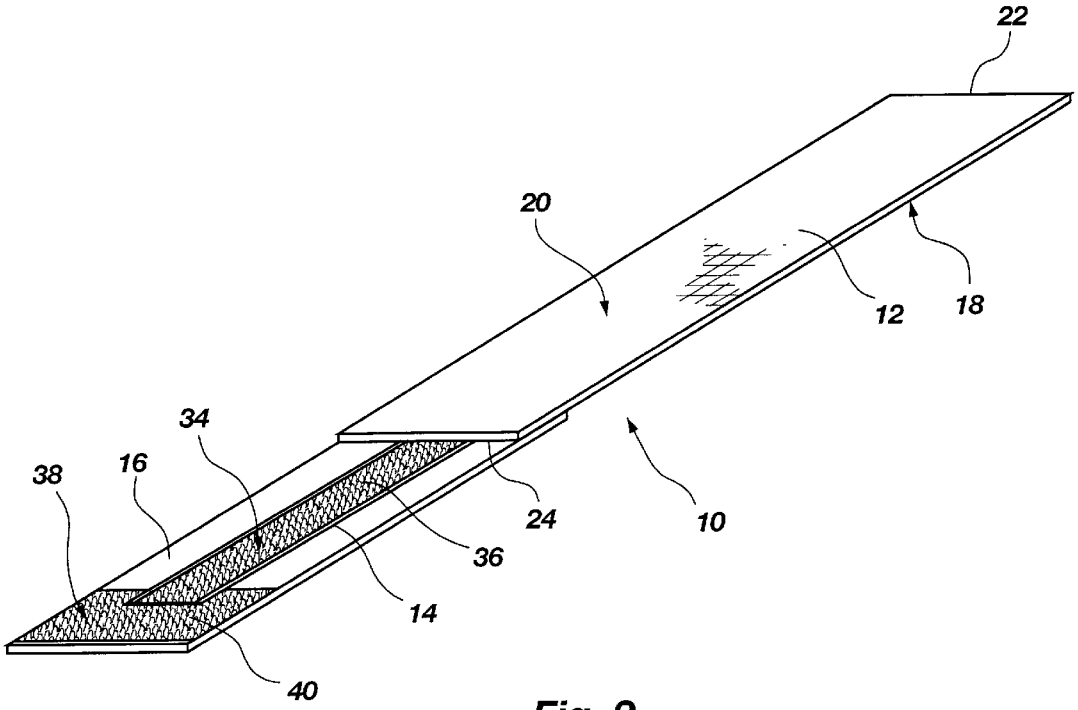
FIG. 2 is a perspective view of the wristband shown in FIG. 1, but where the surface of the wristband which is oriented toward the wearer's body is directed upward.

The wristband 10 of the present invention, as shown in FIGS. 1 and 2, generally comprises a first band 12 which is structured and sized to encircle the wrist of a wearer, a watch-engaging member 14 and a protective cover 16. The first band 12 is generally a flattened length of material, such as, for example, nylon, leather or some other suitable material, and has a first surface 18 for orienting away from the wearer's body and a second surface 20 for orienting toward the wearer's body. The first band 12 has a first end 22 and a second end 24 positioned away from said first end 22. A band closure 26 is positioned on the first surface 18 of the first band 12 and serves to maintain the first band 12 in encircled engagement about the wearer's wrist.

The band closure 26 is shown in FIG. 1 as being one interlocking portion of a hook and loop material of the kind sold under the trademark Velcro®. The band closure 26 may, more particularly, be the nappy portion 28 of the hook and loop material, but may be alternatively structured from the stiffened hook portion of the material. Alternatively, however, the band closure 26 may be structured from any suitable device or structure including, but not limited to, snaps, hooks and eyes, buckles or magnets. The band closure 26 is positioned near the first end 22 of the first band 12 and extends a length or distance along the first band 12 toward the second end 24 thereof. The band closure 26 does not extend the entire length of the first band 12.

The watch-engaging member 14 extends from the second end 24 of the first band 12 in a direction away from the first band 12. The watch-engaging member 14 is structured and sized to retain a watch casing 30 (shown in phantom in FIG. 1), a measuring device, such as a compass, or any other type of ornament desired for wearing on the wrist. The watch-engaging member 14 may, therefore, be a length or ribbon of material as shown, or may take any other suitable configuration sufficient to hold a watch casing, etc. The watch-engaging member 14 has a free end 32 for receiving a watch casing or other device for retention thereon, as shown.

The watch-engaging member 14 extends in length a distance less than the length of the first band 12 such that the watch-engaging member 14 is not long enough to encircle the wearer's wrist. In being so constructed, the wristband 10 is easier to attach to, and detach from, the wrist and advantageously requires less material in manufacture. The watch-engaging member 14 may, therefore, extend a length which is ninety-percent or less the length of the first band 12. Most preferably, the watch-engaging member 14 extends about sixty percent or less the length of the first band 12. Further, the wrist-engaging member 14 may be sized in length to be approximately equal to or shorter in length than the length of the band closure 26.

The watch-engaging member 14 is further structured with a reciprocating closure member 34 which is positioned to engage the band closure 26 to thereby secure the wristband 10 about the wrist. The reciprocating closure member 34 may be any suitable device or structure which co-functions with the band closure 26 to effect securement of the wristband 10 about the wrist. By way of example, and as illustrated in FIG. 2, the reciprocating closure member 34 may be the corresponding hook portion 36 which acts to engage the nappy portion 28 of the band closure 26 shown in FIG. 1. It is the interlocking engagement of the band closure 26 and the reciprocating closure member 34 which secure the wristband 10 in place about the wearer's wrist.

The protective cover 16 also extends from the second end 24 of the first band 12 and extends in the same direction as the watch-engaging member 14. The protective cover 16 may extend in length a distance equal to or greater than the length of the watch-engaging member 14 and may be generally sized to be approximately the same width as the first band 12, although similarity of width is not required. The protective cover 16 may either be a separate portion of material which is connected, such as by stitching or gluing, to the second end 24 of the first band 12 or may be a unitary extension of the first band 12. The protective cover 16 is also structured with a cover closure member 38, which is positioned to engage at least a portion of the band closure 26 to secure the protective cover 16 in position over the watch casing 30. The cover closure member 38 may be any suitable device or structure, but is illustrated as the hook or loop portion 40 of interlocking hook and loop material of the type illustrated for use as the band closure 26.

Figure 3:
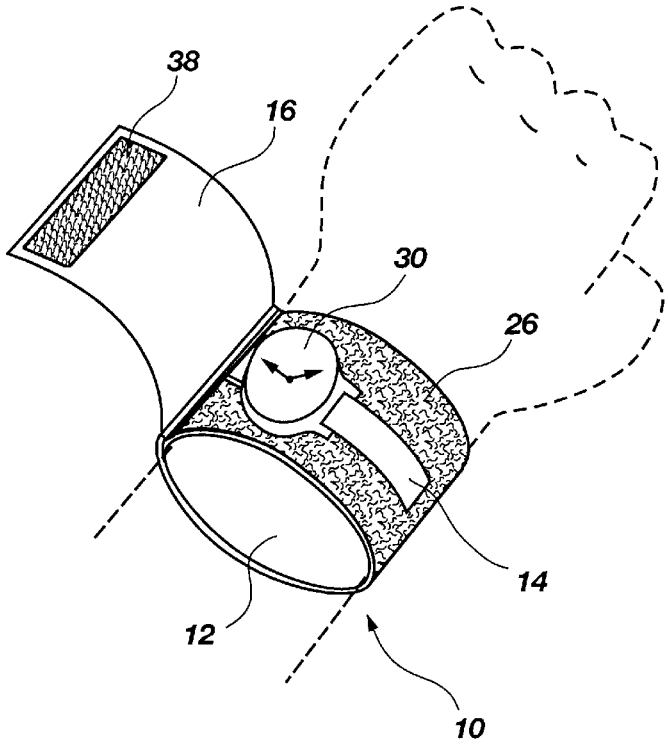
FIG. 3 is a perspective view of the wristband shown in FIGS. 1 and 2, shown attached to a wearer's wrist and having the protective cover oriented away from the watch.
Figure 4:
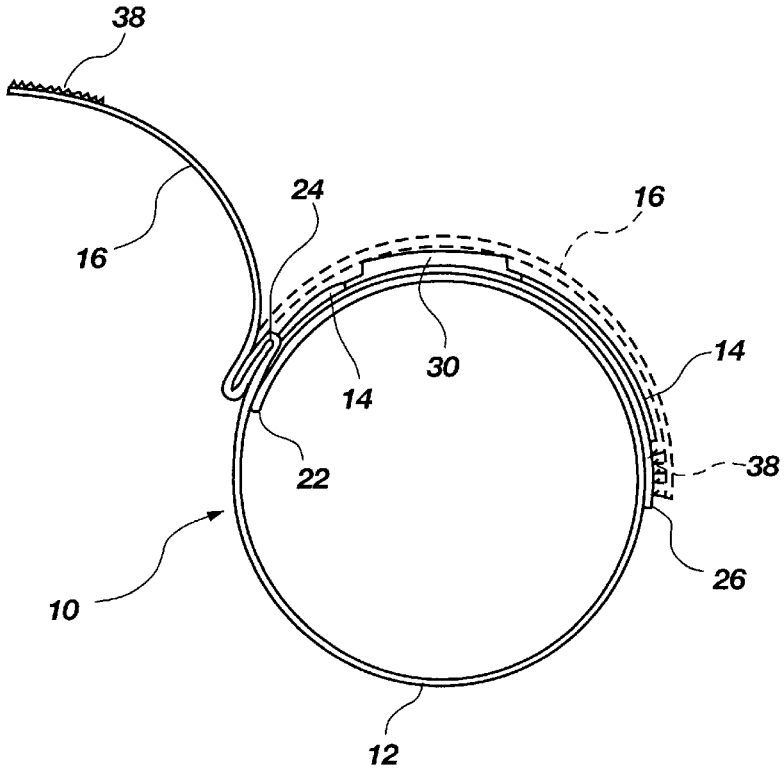
FIG. 4 is a side view in elevation and partial phantom of the wristband shown in FIG. 3.

FIG. 3 more fully illustrates how the watchband 10 of the present invention is attached to a wearer's wrist where the first band 12 encircles the wrist and the watch-engaging member 14 interlocks with the band closure 26 to secure the watchband 10 in place. The protective cover 16 is oriented away from the watch 30 to illustrate these aspects of the invention, but is typically positioned over the watch 30, as shown in FIG. 4 (in phantom lines). FIG. 4 also illustrates more fully the relative lengths and positions of the first band 12, the watch-engaging member 14 and the protective cover 16.

Figure 5:
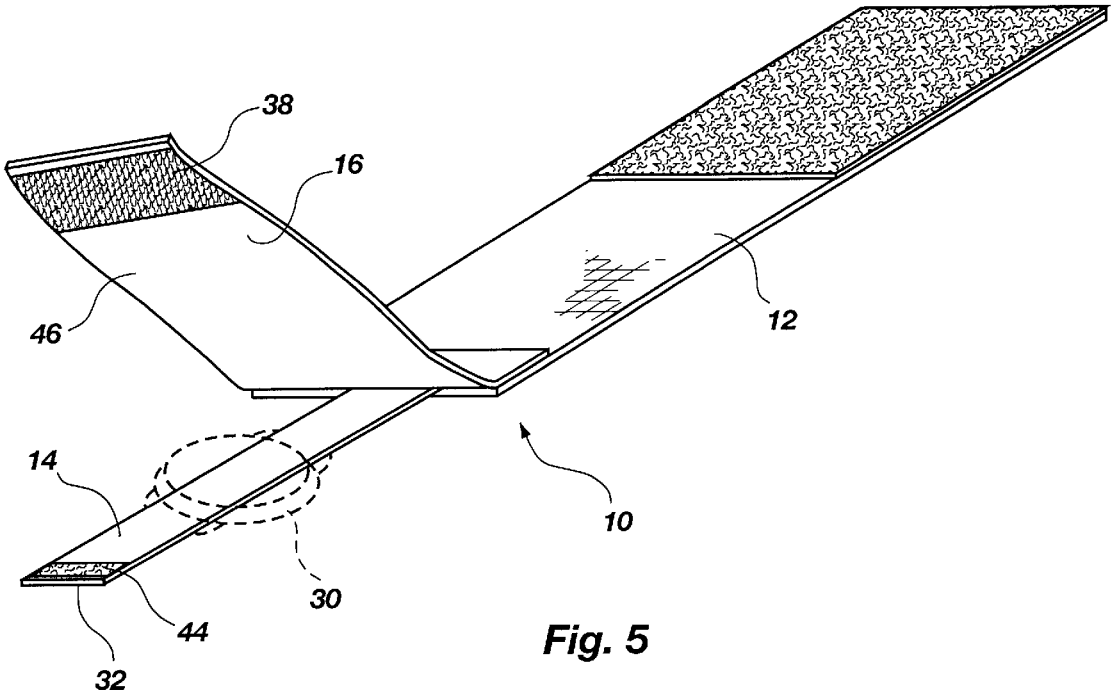
FIG. 5 is a perspective view of a second embodiment of the wristband of the invention.
Figure 6:
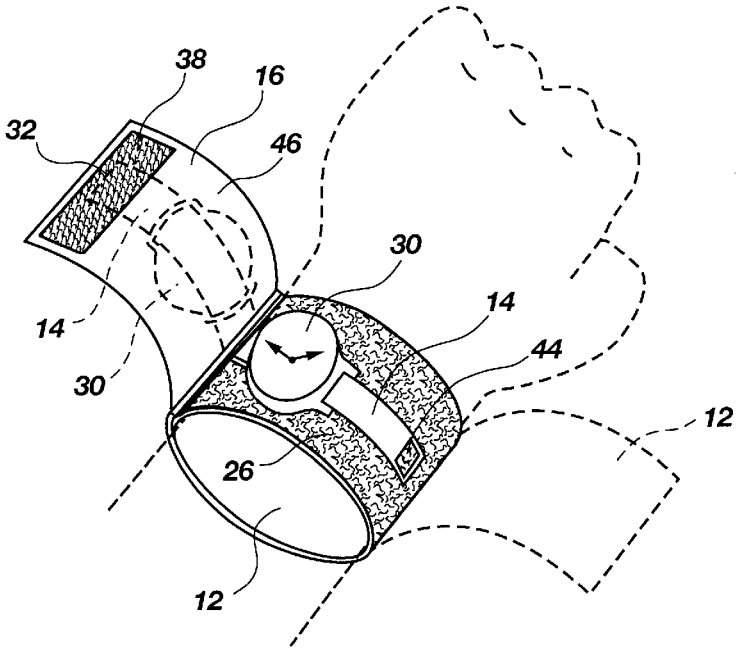
FIG. 6 is a perspective view of the wristband shown in FIG. 5, with certain portions shown in phantom illustrating partial detachment of the wristband from the wearer's wrist.

FIGS. 5 and 6 illustrate a second embodiment of the invention in which the watch-engaging member 14 is further configured with a closure member 44 which is positioned near the free end 32 of the watch-engaging member 14 and is positioned to engage at least a portion of the cover closure member 38 to secure the watch-engaging member 14 to the underside 46 of the protective cover 16. As configured, the watch-engaging member 14 adheres to the protective cover 16, and when the wearer wishes to remove the watchband 10, which is effected by releasing the reciprocating closure member (not shown in FIG. 6) of the watch-engaging member 14 from engagement with the band closure 26, the wearer may lift the protective cover 16 and watch-engaging member 14 simultaneously to disengage the later from the band closure 26. The adherence of the watch-engaging member 14 to the protective cover 16, as shown in phantom at the left side of FIG. 6, secures the free end 32 of the watch-engaging member 14, and thus the watch 30, to the protective cover 16 so that the watch 30 does not slip from the free end 32 of the watch-engaging member 14. The watchband 10 is thereafter easily replaced about the wrist by simply closing the protective cover 16 over the band closure 26.

The present invention provides a wristband with a protective cover which is more easily used by the wearer and which is more economic to manufacture. The wristband is adaptable to any number of items or devices that may wish to be worn about the wearer's wrist. Thus, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. A watchband having a protective cover comprising:

a first band sized in length for encircling the wrist of a wearer, said first band having a first end, a second end, a first surface for orientation away from the wearer's body and a second surface for positioning against the wearer's body;

a band closure positioned along said first surface of said first band from said first end thereof;

a watch-engaging member having a length extending from said second end of said first band a distance less than ninety-percent of said length of said first band, said watch-engaging member having a free end extending in a direction away from said first end and said second end of said first band and having a reciprocating closure member positioned to engage said band closure to effect securement of said first band about the wrist of a wearer; and a protective cover extending from said second end of said first band, said protective cover having a cover closure member positioned to engage at least a portion of said band closure to secure said protective cover in position over said watch-engaging member.

2. The watchband of claim 1 wherein said protective cover extends from said second end a distance equal to or greater than said length of said watch-engaging member.

3. The watchband of claim 1 further comprising a closure member positioned near said free end of said watch-engaging member oriented to engage at least a portion of said cover closure member.

4. A watchband having a protective cover comprising:

a first band sized in length for encircling the wrist of a wearer, said first band having a first end, a second end, a first surface for orientation away from the wearer's body and a second surface for positioning against the wearer's body;

a band closure positioned along said first surface of said first band from said first end thereof and extending a length only partially the length of said first band;

a watch-engaging member having a length extending from said second end of said first band, said watch-engaging member having a free end positioned away from said second end of said first band and having a reciprocating closure member positioned to engage said band closure to effect securement of said first band about a wearer's wrist; and a protective cover extending from said second end of said first band, said protective cover having a cover closure member positioned to engage at least a portion of said band closure to secure said protective cover in position over said watch-engaging member.

5. The watchband of claim 4 wherein said length of said watch-engaging member is equal to or less than the length of said band closure.

6. The watchband of claim 4 where said protective cover extends from said second end a distance equal to or greater than said length of said watch-engaging member.

7. The watchband of claim 4 further comprising a closure member positioned near said free end of said watch-engaging member oriented to engage at least a portion of said cover closure member.

8. A watchband having a protective cover comprising:

a first band sized in length for encircling the wrist of a wearer, said first band having a first end, a second end, a first surface for orientation away from the wearer's body and a second surface for positioning against the wearer's body;

a band closure positioned along said first surface of said first band from said first end thereof;

a watch-engaging member having a length extending from said second end of said first band, said watch-engaging member having a free end positioned away from said second end of said first band and having a reciprocating closure member positioned to engage said band closure to effect securement of said first band about a wearer's wrist; and a protective cover extending from said second end of said first band a distance equal to or greater than said length of said watch-engaging member, said protective cover having a cover closure member positioned to engage at least a portion of said band closure to secure said protective cover in position over said watch-engaging member.

9. The watchband of claim 8 further comprising a closure member positioned near said free end of said watch-engaging member oriented to engage at least a portion of said cover closure member.

10. A watchband having a protective cover comprising:

a first band sized in length for encircling the wrist of a wearer, said first band having a first end, a second end, a first surface for orientation away from the wearer's body and a second surface for positioning against the wearer's body;

a band closure positioned along said first surface of said first band from said first end thereof and extending only partially the length of said first band;

a watch-engaging member having a length extending from said second end of said first band a distance less than ninety-percent of said length of said first band, said watch-engaging member having a free end positioned away from said second end of said first band and having a reciprocating closure member positioned to engage said band closure for encirclement of said first band about a wearer's wrist; and a protective cover extending from said second end of said first band a distance equal to or greater than said length of said watch-engaging member, said protective cover having a cover closure member positioned to engage at least a portion of said band closure to secure said protective cover in position over said watch-engaging member.

11. The watchband of claim 10 further comprising a closure member positioned near said free end of said watch-engaging member oriented to engage at least a portion of said cover closure member.

* * * * *